US005896927A

United States Patent [19]

Roth et al.

[11] Patent Number: 5,896,927

[45] Date of Patent: Apr. 27, 1999

[54] STABILIZING AND CEMENTING LATERAL WELL BORES

[75] Inventors: Thomas M. Roth, Dubai, United Arab Emirates; Khalid Salim, Islamabad, Pakistan

[73] Assignee: Halliburton Energy Services, Inc., Duncan, Okla.

[21] Appl. No.: 08/820,663

[22] Filed: Mar. 17, 1997

[51] Int. Cl.[6] ..... E21B 33/10

[52] U.S. Cl. ..... 166/285; 166/313

[58] Field of Search ..... 166/313, 285, 166/292

[56] References Cited

U.S. PATENT DOCUMENTS

| | | | |
|---|---|---|---|
| 5,301,760 | 4/1994 | Graham | 166/285 |
| 5,353,876 | 10/1994 | Curington et al. | 166/313 |
| 5,477,925 | 12/1995 | Trahan et al. | 166/285 |
| 5,499,681 | 3/1996 | White et al. | 166/382 |
| 5,564,503 | 10/1996 | Longbottom et al. | 166/313 |
| 5,566,763 | 10/1996 | Williamson et al. | 166/382 |
| 5,649,595 | 7/1997 | Davis et al. | 166/285 |

*Primary Examiner*—William Neuder
*Attorney, Agent, or Firm*—Craig W. Roddy; C. Clark Dougherty, Jr.

[57] ABSTRACT

The present invention provides methods of stabilizing the portion of an open-hole lateral well bore adjacent to and extending a distance from the junction of the lateral well bore with a primary well bore to prevent erosion and deformation of the lateral well bore during subsequent drilling and other operations. The methods basically comprise introducing a cement slurry into the portion of the lateral well bore adjacent to and extending a distance from the aforesaid junction under hydraulic pressure whereby the cement slurry enters voids and pore spaces in the walls of the well bore, allowing the cement slurry to set into a hard mass in the lateral well bore and then drilling excess set cement out of the lateral well bore. The stabilization ensures that when a liner is cemented in the lateral well bore, the junction between the liner and the casing in the primary well bore is sealed.

20 Claims, No Drawings

STABILIZING AND CEMENTING LATERAL WELL BORES

BACKGROUND OF THE INVENTION

1. Field of the Invention

The present invention relates generally to stabilizing and cementing lateral well bores, and more particularly, to stabilizing lateral well bores whereby erosion and deformation which adversely affect subsequent primary cementing operations are prevented.

2. Description of the Prior Art

In multi-lateral wells, the lateral well bores are drilled and extend from a single primary well bore. The primary well bore can be substantially vertical or deviated and it can have a plurality of lateral well bores extending therefrom in various directions at the same or different depths. Casing is usually run in the primary well bore and cemented therein prior to the drilling of lateral well bores therefrom. The lateral well bores are typically drilled by sealingly positioning a whipstock in the primary well bore and milling or otherwise forming an opening through the primary well casing and cement. A lateral well bore is then drilled through the opening to a desired length. Thereafter, casing, also referred to as a liner, is usually run into the lateral well bore and cemented therein.

In the cementing of a liner in a lateral well bore, it is mandatory that an effective seal is formed at the junction of the lateral well bore liner to the primary well bore casing. The success in forming such a seal is directly related to the ability to accurately displace a cement slurry into the junction location during the cementing of the liner. However, the open-hole portion of the lateral well bore adjacent to and extending a distance from the junction (primarily the curved portion) is exposed to both erosional and mechanical deformation stresses throughout the lateral well bore drilling process which have the affects of enlarging that portion of the lateral well bore. Further, additional erosional and mechanical stresses are applied to the walls of the lateral well bore when casing is run into the well bore and drilling fluid is circulated through the annulus between the casing and the walls of the well bore. The combined effect of such mechanical and erosional stresses is that the portion of the lateral well bore adjacent its junction with the primary well bore is enlarged, sometimes greatly, as compared to its normal expected size. The enlarged portion of the lateral well bore prevents the predicted quantity of cement slurry displaced into the annulus between a liner and the walls of the well bore during primary cementing from reaching the junction of the lateral well bore with the primary well bore and consequently a seal at the junction does not result.

Thus, there is a need for methods of stabilizing a lateral well bore at its junction with a primary well bore to prevent erosion and deformation and to allow an effective seal at the junction to be formed when a liner is cemented in the lateral well bore.

SUMMARY OF THE INVENTION

The present invention provides methods of stabilizing the portion of an open-hole lateral well bore adjacent to and extending a distance from the junction of the lateral well bore with a primary well bore to prevent the erosion and deformation of the lateral well bore during subsequent drilling and other operations. The methods basically comprise the steps of introducing a cement slurry into the portion of the lateral well bore adjacent to and extending a distance from the junction of the lateral well bore under hydraulic pressure whereby the cement slurry enters voids and pore spaces in the walls of the well bore. The cement slurry is allowed to set into a hard mass in the well bore followed by the drilling of excess set cement out of the well bore. The resultant lateral well bore is greatly strengthened and resists erosion and deformation during subsequent drilling and other operations performed therein.

The present invention also provides methods of stabilizing a lateral well bore and subsequently running and cementing a liner therein whereby the junction between the lateral well bore liner and the primary well bore casing is effectively sealed.

It is, therefore, a general object of the present invention to provide methods of stabilizing and cementing lateral well bores.

Other and further objects, features and advantages of the present invention will be readily apparent by those skilled in the art upon a reading of the description of preferred embodiments which follows.

DESCRIPTION OF THE PREFERRED EMBODIMENTS

As mentioned, it is mandatory that the liners cemented in the lateral well bores of a multi-lateral well are sealed by set cement at their junctions with the casing in the primary well bore. Heretofore, such sealing has often not been accomplished due to the enlargement of the lateral well bores at and near the curved portions thereof adjacent to their junctions with the primary well bore. That is, the open-hole portion of a lateral well bore adjacent to and extending a short distance from the junction with the primary well bore, i.e., a distance of from about 10 to about 100 feet from the junction, is exposed to erosional and mechanical deformation stresses during subsequent drilling and other operations. Such stresses often cause the enlargement of the aforesaid portion of the lateral well bore whereby the predicted required quantity of cement slurry displaced into the annulus between a liner and the walls of the lateral well bore during primary cementing does not reach the junction of the lateral well bore with the primary well bore. Consequently, a seal at the junction does not result.

In accordance with the present invention, the aforesaid portion of an open hole lateral well bore adjacent the junction of the lateral well bore with a primary well bore is stabilized whereby it resists enlargement during drilling and other operations. Further, the junction portion of the lateral well bore can optionally be restabilized after drilling and before running a liner in the lateral well bore to further ensure that only minimum enlargement, if any, takes place. Thereafter, the liner can be cemented in the lateral well bore with confidence that the cement slurry utilized is displaced into the location of the junction and seals it.

The methods of the present invention for stabilizing the portion of an open hole lateral well bore adjacent to and extending a distance from the junction of the lateral well bore with a primary well bore are basically comprised of the following steps. A cement slurry is introduced into the portion of the lateral well bore adjacent the aforesaid junction under hydraulic pressure whereby the cement slurry is forced to enter voids and pore spaces in the walls of the well bore. The cement slurry is allowed to set into a hard mass in the well bore and excess cement slurry is then drilled out of the well bore. The set cement significantly strengthens and stabilizes the walls of the well bore against erosional and mechanical deformation stresses subsequently applied to the well bore.

The cement slurry utilized in accordance with the methods of this invention is basically comprised of water and a hydraulic cement. A variety of hydraulic cements can be utilized in accordance with this invention. Portland cement is generally preferred, and can be, for example, one or more of the various Portland cements designated as API Classes A-H cements. These cements are identified and defined in the *API Specification For Materials And Testing For Well Cements*, API Specification 10, 5th Edition, dated Jul. 1, 1990 of the American Petroleum Institute. API Portland cements generally have a maximum particle size of about 90 microns and a specific surface of about 3,900 square centimeters per gram. Other hydraulic cements which are equivalent to API Portland cements can also be utilized.

More preferred hydraulic cements for use in accordance with this invention are those which are ultra fine whereby they more readily enter the voids and pore spaces in the walls of a well bore and relatively quickly develop gel strength and set therein. Such ultra fine particulate hydraulic cements have a maximum particle size of about 15 microns and a specific surface of about 12,000 square centimeters per gram. The distribution of the various size particles within the ultra fine cementitious material having a maximum particle size of about 15 microns is such that about 90% of the particles have diameters no greater than about 10 microns, 50% have diameters no greater than about 5 microns and 20% of the particles have diameters no greater than about 3 microns.

The specific surface area of the ultra fine hydraulic cement (sometimes also referred to as Blaine Fineness) is an indication of the ability of the cement to chemically interact with other materials. The specific surface is preferably greater than about 12,000 square centimeters per gram and more preferably about 13,000 square centimeters per gram.

Ultra fine cements having maximum particle sizes and surface areas as set out above are disclosed in various U.S. patents including U.S. Pat. No. 4,761,183 issued to Clarke during August, 1988 which discloses ultra fine particle size cement formed of slag and mixtures thereof with Portland cement, and U.S. Pat. No. 4,160,674 issued to Sawyer during July, 1979 which discloses ultra fine particle size Portland cement. The ultra fine particle size hydraulic cement preferred in accordance with this invention is Portland cement and combinations thereof with slag wherein the quantity of Portland cement in the mixture is preferably no less than about 40% by weight, more preferably about 60% by weight and most preferably 100%. Methods of utilizing ultra fine particle size hydraulic cement in primary and squeeze cementing operations are disclosed in U.S. Pat. Nos. 5,121,795 issued to Ewert et al. on Jun. 16, 1992 and 5,125,455 issued to Harris et al. on Jun. 30, 1992, both of which are incorporated herein by reference.

The water used in the cement slurries useful in accordance with this invention can be water from any source provided it does not contain an excess of compounds which adversely react with the cement or other additives in the slurries. For example, the water can be fresh water, salt water, brines or seawater. In offshore applications, it is convenient to utilize seawater for forming the cement slurries. The water is present in an amount sufficient to form a slurry of the cement which is readily pumpable. Generally, the water is present in the range of from about 45% to about 450% by weight of the hydraulic cement in the composition.

The cement slurries can utilize a variety of well known additives to provide required properties for particular applications. One such additive is a defoaming additive for preventing foaming during mixing and pumping of a cement slurry. The defoaming additive can comprise substantially any of the compounds known for such capabilities such as the polyol silicone compounds. Particularly suitable such additives are commercially available from Halliburton Energy Services of Duncan, Okla., under the trade designation "D-AIR®." Defoaming additives are generally mixed with the cement slurries in amounts in the range of from about 0.1% to about 0.5% by weight of the cement therein. Other additives which can be utilized in the cement slurries include set retarding additives, early strength accelerators such as sodium chloride, extenders, compressive strength enhancers and the like which are well known to those skilled in the art.

After the open hole portion of a lateral well bore adjacent to and extending a distance from the junction of the lateral well bore with a primary well bore has been stabilized as described above to prevent or reduce its erosion and deformation, the lateral well bore is drilled to completion, i.e., to a desired length. Thereafter, depending upon the type of formation in which the lateral well bore is being drilled and the likelihood that it will have suffered enlargement during the drilling process, the portion of the well bore adjacent the junction can optionally again be stabilized. That is, additional cement slurry can be introduced into the portion of the well bore adjacent the junction under hydraulic pressure whereby the cement slurry enters additional voids and pore spaces formed in the walls of the well bore. The cement slurry is allowed to set into a hard substantially impermeable mass in the well bore and the well bore is redrilled thereby insuring it is of the expected size. Thereafter, a liner is run in the well bore and cemented therein.

The cementing of the liner known as primary cementing is well known to those skilled in the art and involves the displacement of a cement slurry into the annulus between the liner and the walls of the lateral well bore from the end of the liner opposite the end thereof which joins the primary well bore. Prior to introducing the cement into the annulus, the annulus normally contains drilling fluid. A specific quantity of a cement slurry is displaced through the liner and into the annulus using a displacement fluid such as additional drilling fluid. As the cement slurry is displaced into the annulus, the drilling fluid in the annulus is displaced out of the annulus by the cement slurry. The quantity of cement slurry utilized is carefully determined based on the diameter of the lateral well bore and the outside diameter of the liner whereby upon completion of the cement slurry displacement, it fills the annulus and extends into the location of the junction between the liner and the casing in the primary well bore so that the junction is sealed.

Thus, the method of the present invention for stabilizing the portion of an open-hole lateral well bore adjacent the junction of the lateral well bore with a primary well bore to prevent its erosion and deformation followed by drilling the lateral well bore to completion, cementing a liner in the well bore and sealing the junction is comprised of the following steps. A cement slurry, preferably an ultra fine cement slurry, is introduced into the portion of the lateral well bore adjacent to and extending a distance from the junction under hydraulic pressure whereby the cement slurry enters voids and pore spaces in the walls of the well bore. The cement slurry is allowed to set into a hard substantially impermeable mass in the well bore and the well bore is redrilled to remove excess cement from the well bore. The drilling of the lateral well bore is then completed followed by running a liner in the well bore and cementing the liner in the well bore.

As mentioned above, the steps of introducing a cement slurry into the portion of the lateral well bore adjacent the junction under hydraulic pressure, allowing the cement slurry to set and redrilling the well bore can be repeated after the drilling of the lateral well bore has been completed and before a liner is run and cemented in the well bore.

As is also well understood by those skilled in the art, the liner cementing process generally includes the step of circulating drilling fluid through the annulus between the liner and the walls of the well bore after the liner has been run therein to clean debris such as cuttings and gelled drilling fluid out of the annulus. Thereafter, the cement slurry utilized is displaced into the annulus and into the location of the junction between the liner and casing in the primary well bore whereupon the cement slurry is allowed to set into a hard substantially impermeable mass.

Thus, the present invention is well adapted to carry out the objects and attain the benefits and advantages mentioned as well as those which are inherent therein. While numerous changes to the methods can be made by those skilled in the art, such changes are encompassed within the spirit of this invention as defined by the appended claims.

What is claimed is:

1. A method of stabilizing the portion of an open-hole lateral well bore adjacent to and extending a distance from the junction of the lateral well bore with a primary well bore to prevent the erosion and deformation of the lateral well bore during subsequent drilling and other operations comprising the steps of:

(a) introducing a cement slurry into said portion of said open-hole lateral well bore under hydraulic pressure whereby said cement slurry enters voids and pore spaces in the walls of said well bore;

(b) allowing said cement slurry to set into a hard mass in said open-hole lateral well bore; and (c) drilling excess set cement out of said lateral well bore.

2. The method of claim 1 wherein said cement slurry is comprised of water and a hydraulic cement.

3. The method of claim 2 wherein said hydraulic cement is Portland cement.

4. The method of claim 2 wherein said hydraulic cement is an ultra fine particulate cement having a maximum particle size of about 15 microns.

5. The method of claim 1 which further comprises the steps of:

running a liner into said lateral well bore after step (c); and cementing said liner in said lateral well bore.

6. The method of claim 5 wherein the step of cementing said liner in said lateral well bore comprises the steps of:

circulating drilling fluid through the annulus between said liner and the walls of said well bore to clean said annulus;

displacing a cement slurry into the annulus; and allowing said cement slurry to set into a hard mass in said annulus.

7. A method of stabilizing the portion of an open-hole lateral well bore adjacent to and extending a distance from the junction of the lateral well bore with a primary well bore to prevent the erosion and deformation of the lateral well bore during subsequent drilling and other operations comprising the steps of:

(a) introducing a cement slurry into said portion of said open-hole lateral well bore adjacent said junction under hydraulic pressure whereby said cement slurry enters voids and pore spaces in the walls of said well bore;

(b) allowing said cement slurry to set into a hard mass in said open-hole lateral well bore;

(c) drilling excess set cement out of said lateral well bore and continuing the drilling of said lateral well bore to its completion;

(d) running a liner in said lateral well bore; and (e) cementing said liner in said lateral well bore.

8. The method of claim 7 wherein said cement slurry of step (a) is comprised of water and a hydraulic cement.

9. The method of claim 8 wherein said hydraulic cement is Portland cement.

10. The method of claim 8 wherein said hydraulic cement is an ultra fine particulate cement having a maximum particle size of about 15 microns.

11. A method of stabilizing the portion of an open-hole lateral well bore adjacent to and extending a distance from the junction of the lateral well bore with a primary well bore to prevent the erosion and deformation of the lateral well bore during subsequent drilling and other operations comprising the steps of:

(a) introducing a cement slurry into said portion of said open-hole lateral well bore adjacent said junction under hydraulic pressure whereby said cement slurry enters voids and pore spaces in the walls of said well bore;

(b) allowing said cement slurry to set into a hard mass in said open-hole lateral well bore;

(c) drilling excess set cement out of said lateral well bore and continuing the drilling of said lateral well bore to its completion;

(d) introducing additional cement slurry into said portion of said lateral well bore under hydraulic pressure whereby said cement slurry enters any additional voids and pore spaces in the walls of said lateral well bore;

(e) allowing said cement slurry to set into a hard mass in said lateral well bore;

(f) drilling excess set cement out of said lateral well bore;

(g) running a liner in said lateral well bore; and (h) cementing said liner in said lateral well bore.

12. The method of claim 11 wherein the step of cementing said liner in said lateral well bore comprises the steps of:

circulating drilling fluid through the annulus between said liner and the walls of said well bore to clean said annulus;

displacing a cement slurry into the annulus; and allowing said cement slurry to set into a hard mass in said annulus.

13. A method of stabilizing the portion of an open-hole lateral well bore adjacent to and extending a distance from the junction of the lateral well bore with a primary well bore to prevent the erosion and deformation of the lateral well bore during subsequent drilling and other operations comprising the steps of:

(a) introducing a cement slurry into said portion of said lateral well bore under hydraulic pressure whereby said cement, slurry enters voids and pore spaces in the walls of said well bore;

(b) allowing said cement slurry to set into a hard mass in said well bore;

(c) drilling excess set cement out of said well bore and continuing the drilling of said well bore to its completion;

(d) introducing additional cement slurry into said portion of said lateral well bore adjacent said junction under hydraulic pressure whereby said cement slurry enters additional voids and pore spaces in the walls of said well bore;

(e) allowing said cement slurry to set into a hard mass in said well bore;

(f) drilling excess cement out of said well bore;

(g) running a liner in said well bore; and (h) cementing said liner in said well bore.

14. The method of claim 13 wherein said cement slurry of step (a) is comprised of water and a hydraulic cement.

15. The method of claim 14 wherein said hydraulic cement is Portland cement.

16. The method of claim 14 wherein said hydraulic cement is an ultra fine particulate cement having a maximum particle size of about 15 microns.

17. The method of claim 13 wherein the step of cementing said casing in said lateral well bore comprises the steps of:

circulating drilling fluid through the annulus between said liner and the walls of said well bore to clean said annulus;

displacing a cement slurry into the annulus; and allowing said cement slurry to set into a hard mass in said annulus.

18. The method of claim 17 wherein said cement slurry displaced into said annulus is comprised of water and a hydraulic cement.

19. The method of claim 18 wherein said hydraulic cement is Portland cement.

20. The method of claim 18 wherein said hydraulic cement is an ultra fine particulate cement having a maximum particle size of about 15 microns.

* * * * *